US005310007A

United States Patent [19]

Parikh

[11] Patent Number: 5,310,007

[45] Date of Patent: May 10, 1994

[54] TENSIONING RING AND RISER ASSEMBLY FOR AN OIL WELL PLATFORM TENSIONING APPARATUS

[75] Inventor: Mahendra Parikh, Houston, Tex.

[73] Assignee: Paul Munore Engineering International, Orange, Calif.

[21] Appl. No.: 45,615

[22] Filed: Apr. 9, 1993

[51] Int. Cl.[5] ..... E21B 17/00

[52] U.S. Cl. ..... 166/355

[58] Field of Search ..... 166/353-355, 166/343, 345, 349

[56] References Cited

U.S. PATENT DOCUMENTS

| | | | |
|---|---|---|---|
| 4,428,433 | 1/1984 | Watkins | 166/355 X |
| 4,799,827 | 1/1989 | Jaqua | 166/355 X |
| 4,808,035 | 2/1989 | Stanton et al. | 166/355 X |

*Primary Examiner*—Thuy M. Bui

*Attorney, Agent, or Firm*—Frank D. Gilliam

[57] ABSTRACT

A tensioning ring and riser assembly for use in oil well platform riser tensioning apparatus. The cylindrical riser has male threads formed on the exterior surface. The annular tensioning ring has female threads formed on the interior adapted to loosely thread onto the male threads. The tensioning ring is adapted to be tensioned in a first direction relative to the riser. The female threads have a leading face lying at a shallow angle to the assembly centerline in the first direction and a trailing face lying approximately perpendicular to the assembly centerline. The male threads have a complementary configuration. When the tensioning ring is tensioned in the first direction, the shallow angled faces are brought into tangential pressure contact so that hoop stress is uniformly distributed and minimized in both riser and tensioning ring with the shear load between them distributed over the wall thickness of both parts. When the tensioning force is released, the only contact is at the faces that lie approximately perpendicular to the centerline. This contact is under little pressure and has a minimal contacting area, allowing easy rotation of the tensioning ring relative to thread the tensioning ring up or down the riser. A rounded root between the threads on each part allows clearance for thread tips as the threads move between the tensioned and untensioned positions.

18 Claims, 2 Drawing Sheets

TENSIONING RING AND RISER ASSEMBLY FOR AN OIL WELL PLATFORM TENSIONING APPARATUS

BACKGROUND OF THE INVENTION

This invention relates in general to tensioning of risers used in offshore oil production and exploratory drilling and, more specifically, to an improved tensioning ring and slip assembly for fastening a riser tensioning apparatus to a riser pipe suspended from an offshore drilling vessel or floating platform. Off shore oil drilling and production operations are conducted through a pipe, called a riser, running from the subsea wellhead to the surface platform or floating vessel. In order to support the weight of these risers and to control the stresses induced by ocean currents and vessel motions, the upper end of the riser is connected to a tensioning device. This riser tensioner maintains a predetermined range of tension throughout the range of vertical and lateral motions of the drilling or production rig. The conventional approach to tensioning risers is to use a combination of a hydraulic or pneumatic mechanical cylinder, pressurized using a compressed gas, to apply the tensioning forces to the riser. Each riser tensioner is located on a deck of the floating platform or floating vessel and structurally connected through its cylinders to the riser. The cylinders are typically connected to the risers through cylinder rods. The rods are connected to a tension ring which may be threaded directly onto, or otherwise connected to, a slip assembly surrounding and fastened to the riser pipe. The tension ring and/or slip assembly generally is movable along the riser to permit positioning in an optimum position with the cylinders extended in an optimum manner. Where the tension ring is threaded onto the riser, this adjustment is accomplished by rotating the tension ring. Typical of such systems is that disclosed by Myers et al in U.S. Pat. No. 4,883,387, which uses a conventional thread or spiral groove on a riser top joint engaging a tensioner ring.

Because of the high tension between base and tensioning ring during normal operation, rotating the ring or slip assembly to thread the ring up or down along the riser is often very difficult. The ring or slip assembly and riser are often jammed together with tight threads so that even when the tension is released rotation of the ring is very difficult.

The thread forms used are subject to deformation which increases the difficulty of rotation. Further, tight machining tolerances for the threads are required to prevent further problems in rotating the ring. A great variety of thread forms have been developed for widely varying, specific, purposes. For example, rounded threads such as are described by Johansson et al in U.S. Pat. No. 3,645,570 have been developed for percussion drill rods. Rounded thread bottoms such as are described by Frerejacques in U.S. Pat. No. 4,861,210 have been designed to reduce stress. Non-symmetrical threads are disclosed by Ditson in U.S. Pat. No. 4,063,837 for connecting lengths of drill rod together. The prior thread forms, however, do not address the problems which occur in tension ring assemblies.

Therefore, there is a continuing need for tension ring and/or slip assemblies for riser tensioning systems that operate well in the difficult environment, permit ease of rotation and ease of positioning when tension is released, resist deformation under tension and do not require tight manufacturing tolerances.

SUMMARY OF THE INVENTION

The above-noted problems, and others, are overcome in accordance with this invention by a tensioning ring and/or slip assembly having a unique mating thread configuration providing low distortion engagement when the assembly is under tension while permitting very low force rotation of the tension ring or slip assembly around the riser when under no load.

Male threads are formed on the exterior surface of the riser with cooperating, loose, female threads formed on the interior surface of the tensioning ring (which may be solid or split, with interior slips, as described below) so that the tensioning ring can easily thread onto the riser. The female and male threads could each be formed as a single thread or multiple parallel threads, as desired.

When the tensioning ring is forced in a first axial direction relative to the riser, the leading faces of the female threads are forced into pressure contact with the trailing faces of the male threads. These faces preferably have corresponding angles to the centerline of the assembly of from about 9° to 18°, considering the centerline to extend in said first axial direction. The trailing face of the female threads and the corresponding leading edge of the male threads preferably have an angle to that centerline of from about 88° to 90°. For optimum results the leading faces of the female threads and trailing faces of the male threads have an angle to that centerline of about 15° while the opposite faces have an angle of about 88.5°.

As detailed below, with the loose fit between the male and female threads, and the relative axial movement of those threads between the tensioned and unloaded conditions, a scalloped or rounded thread root is provided to permit that movement. While other rounded cross sections may be used if desired, an elliptical cross section is preferred, with the major axis of the ellipse lying approximately parallel to the assembly centerline. For optimum results, an ellipse having a ratio of length to width of about 2:1 is preferred.

When the axial tensioning force is removed, the only contact between the two threads is at the trailing face of the female thread and the leading face of the male thread. This contact yields minimal surface area contact allowing minimal effort to be expended in rotating the tension ring or slip assembly around the riser. Thus, the tension ring and/or slip assembly can be easily threaded up and down the riser to adjust the tension ring for optimal riser tension operation. When the tension ring is forced upward by the action of the riser tensioner, the low angle, tangential, surfaces of the threads are forced together. This action also removes any contact between the trailing faces of the female threads and the leading faces of the male threads. In result, hoop stress is uniformly distributed and minimized in both the tension ring and riser and the shear load between the two pieces is smoothly distributed over the wall thickness of both pieces.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
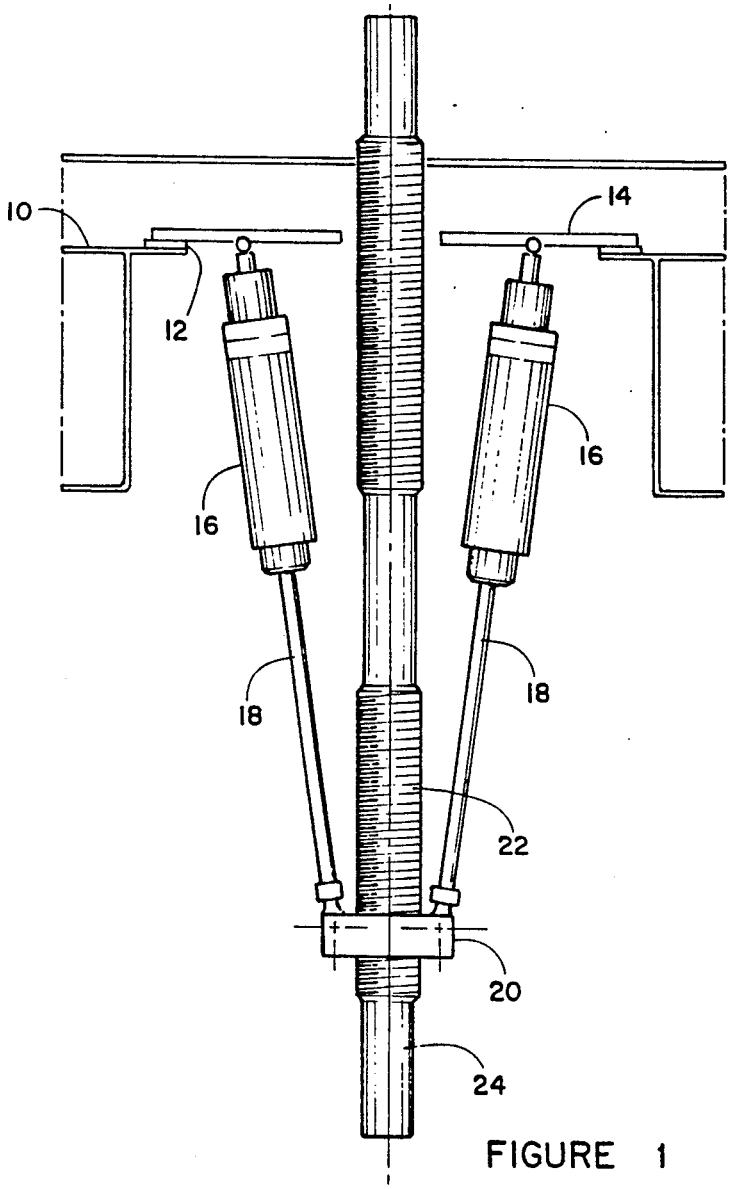
FIG. 1 is a schematic elevation view of a riser tensioning assembly incorporating the system of this invention.

Referring now to FIG. 1, there is seen a riser tensioner assembly useful with oil well platforms and the like. A portion of platform 10 is shown, with an opening 12 covered by a plate 14. A plurality of tensioning cylinders 16, typically four, are secured to plate 14 and exert an upward pull on cylinder rods 18. Any conventional tensioning cylinders may be used. A preferred tensioning cylinder is disclosed in copending U.S. patent application Ser. No. 07/912,734, filed Jul. 13, 1992 and assigned to the assignee of this application.

The extended end of each rod is fastened by shackles or the like to a tensioning ring 20 which surrounds and is threaded onto a riser 22. Relative rotation of riser 22 and tensioning ring 20 will cause tensioning ring 20 to move up or down riser 22, permitting the position of the extended ends of rods 18 to be optimized.

Figure 2:
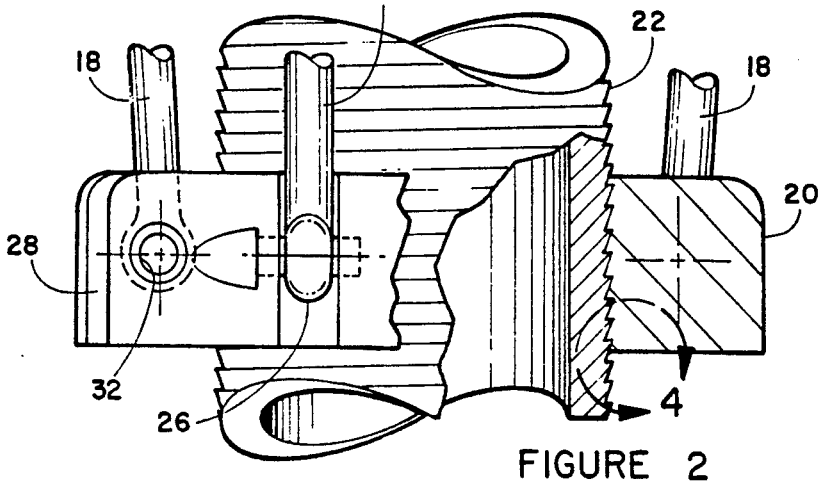
FIG. 2 is an elevation view, partly cut-away, of the tension ring and riser assembly.

Details of a first embodiment of the assembly of tensioning ring 20 and riser 22 are shown in FIG. 2. Tensioning ring 20 and riser 22 have cooperating threads of unique configuration, as detailed below, formed on the inner and outer surfaces, respectively. The extended ends of rods 18 have bosses 26 with transverse holes therethrough. Bosses 26 fit within slots 28 in tensioning ring 20. Bolts or pins extend through holes 32 in tensioning ring 20 aligned with holes in bosses 26 to retain rods 18 in place while permitting easy removal and permitting the rods to pivot in the planes in which riser 22 and the rods lie.

Figure 3:
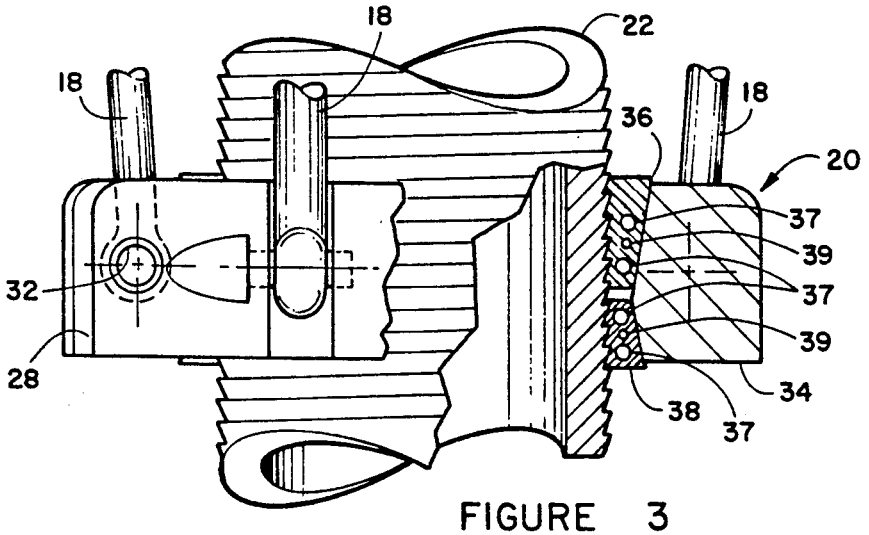
FIG. 3 is an elevation view, partly cut-away, of a second embodiment of the assembly of FIG. 2.

A second embodiment of the assembly of tensioning ring 20 and riser 22 is illustrated in FIG. 3. The arrangement of riser 22, rods 18, tensioning ring slots 28 and holes 32 is basically the same as in FIG. 2. In this embodiment, however, Tensioning ring 20 is made up of an outer ring 34, a split upper slip ring 36 and a split lower nut 38 having internal threads conforming to those on the exterior of riser 22. This assembly is threadable upwardly or downwardly along riser 22.

Split upper slip 36 and split lower nut 38 are each in two halves, split axially. The two halves are secured together by bolts 37 and dowels 39 extending between the two halves the halves are positioned using dowels 39. Bolts 37 extend through holes with countersunk outer ends to accommodate the bolt head and nut. Split slip ring 36 and split lower nut 38 both have holes drilled into them to permit rotation using a conventional spanner wrench. The advantages of the split ring halves embodiment include the ability to be secured to a riser 22 with flanges on both ends, if desired, thereby reducing the bore and outside diameter required. This reduces the overall weight and stresses on tensioning ring 20 and also permits adjustment of tensioning ring 20 by rotating split upper slip 36 and split lower nut 38 without removal or rotation of tensioning ring 20. Should a part become worn or damaged, replacement of a portion of the assembly is less costly than replacing major components.

Figure 4:
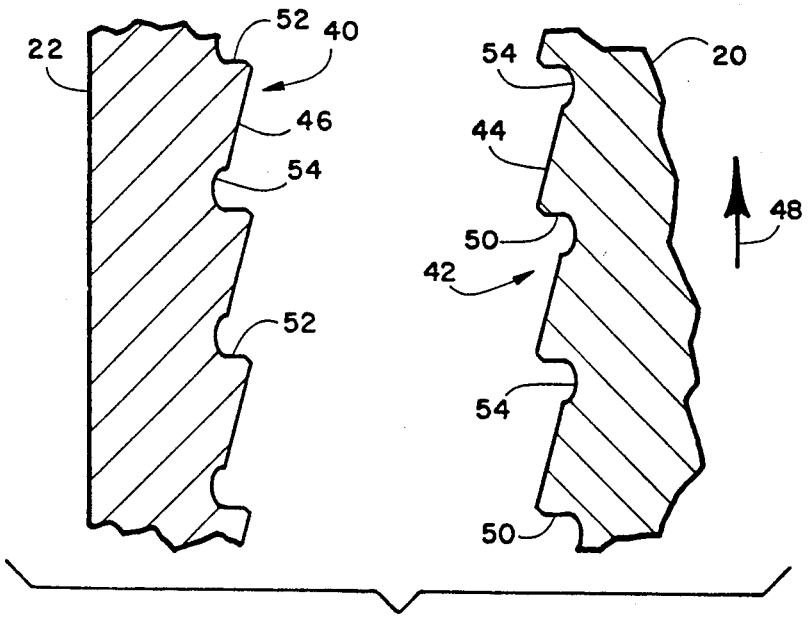
FIG. 4 is a schematic detail section view showing the thread configuration.

Details of the unique thread form are illustrated in FIG. 4, which is a detail section view take at approximately 4—4 in FIG. 2. Male threads 40 are formed on riser 22 and female threads 42 are formed on tensioning ring 20 or slips 36 and nut 38 by any conventional method. A single thread or a plurality of parallel threads may be used, as desired. As detailed below, the threads should mesh loosely, so that high tolerance thread forming is not required.

The leading faces 44 of female threads 42 and trailing faces 46 of male threads 40 have complementary shapes and lie at a shallow angle to the assembly centerline. Preferably, that angle is from about 9° to 18°. An angle of about 15° provides optimum performance in most cases. That angle is taken to the centerline extending in a first direction, the direction that tensioning ring 20 is pulled when the system is in operation, upwardly as illustrated by arrow 48.

The trailing faces 50 of female threads 42 and the leading faces 52 of male threads 40 have complementary shapes and lie approximately perpendicular to the assembly centerline. An angle of from about 88° to 90° to the first centerline is preferred. Optimum results are generally obtained with an angle of about 88.5°.

The root 54 of each thread is rounded to provide thread tip clearance as detailed below. While any rounded root cross section may be used, best results are obtained with an elliptical cross section with the longer axis substantially parallel to the assembly centerline. Optimally, the ellipse has a length parallel to the assembly centerline approximately twice the width of the ellipse. The tips of the threads are preferably rounded slightly, primarily toward the face that is approximately perpendicular to the assembly centerline for clearance in operation as discussed below.

Figure 5:
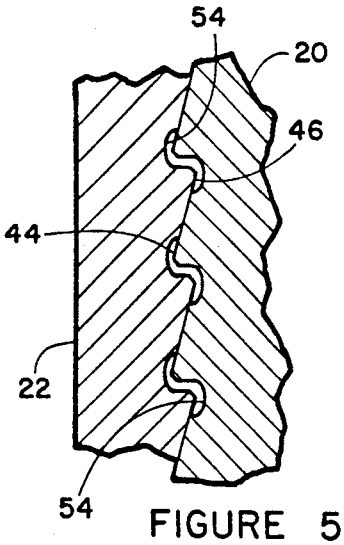
FIG. 5 is a schematic detail section view showing the tension ring and riser in the loaded condition.
Figure 6:
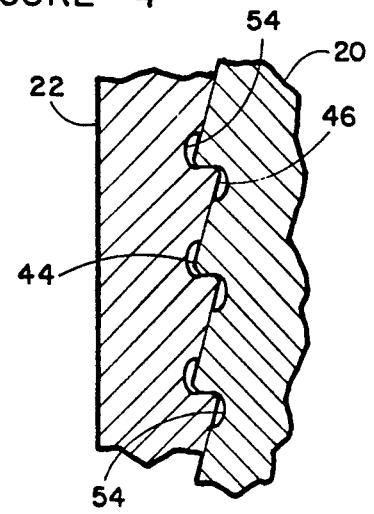
FIG. 6 is a schematic detail section view showing the tension ring and riser in the unloaded condition.

The threads are shown in the operating relationship in FIGS. 5 and 6, with FIG. 5 showing the "loaded" or tensioned position and FIG. 6 showing the "unloaded" or untensioned position for threading the tension ring up or down the riser. These Figures are detail section views taken approximately in area 4—4 of FIG. 2.

As indicated by arrow 48 in FIG. 4, tensioning ring 20 is being pulled upwardly relative to riser 22. This brings the leading face 44 of the tensioning ring threads into tight pressure contact with the trailing face 46 of the riser. With these parallel surfaces forced together, the tips of the teeth of each part are out of contact with the other part, lying within the rounded roots 54. Thus, hoop stress is uniformly distributed and minimized in both riser 22 and tensioning ring 20, with the shear load between the contacting faces smoothly distributed over the wall thickness of both parts.

When tension is relieved in tensioning ring 20, the weight of the ring causes the ring to move downwardly relative to riser 22 to the unloaded position shown in FIG. 6. The leading face 44 of tensioning ring 20 moves out of contact with the trailing face of riser 22 while the other faces come into contact due to the slightly oversize or loose fit of the threads. The thread tips of the threads move downwardly within the rounded root 54 to a position preferably just out of contact therewith. In this position, the leading face 44 of tensioning ring 20 exerts no normal force against the trailing face 46 of riser 22. The contact between the substantially perpendicular faces is minimal, and under only slight pressure from the weight of the tensioning ring. Thus, relative rotation between tensioning ring 20 and riser 22 can be accomplished easily to thread the tensioning ring up or down the riser. Because of the desired loose fit between the parts, economy in manufacturing is realized through the intentional wide tolerance between male threads 40 and female threads 42. This is of particular benefit with the split embodiment of FIG. 3 where previous thread designs were not effective due to problems in manufacturing and material stress limitations in the geometry of the split threaded parts.

Other applications, variations and ramifications of this invention will occur to those skilled in the art upon reading this disclosure. Those are intended to be included within the scope of this invention, as defined in the appended claims.

I claim:

1. A tensioning ring and riser assembly for use in a riser tensioning apparatus which comprises:

a riser having male threads formed on the exterior surface;

a tensioning ring having female threads formed on the interior surface;

said female threads configured and sized to thread onto said male threads with a loose fit;

said female threads having leading faces adapted to be axially forced against the corresponding trailing faces of said male threads in a first direction along the centerline of said assembly of tensioning ring and riser;

the leading faces of said female threads and trailing faces of said male threads extending in said first direction having an angle to said centerline in said first direction of less than about 30°;

the trailing faces of said female threads and leading faces of said male threads having an angle to said centerline in said first direction of at least about 70°;

the thread roots of said male and female threads having a rounded cross section;

whereby when said tension ring is forced in said first direction only the low angle faces of the threads are in contact and when there is no force in said first direction the only contact is at the trailing face of the female thread root and the leading face of the male thread crest permitting rotation of the tensioning ring around the riser with minimal effort.

2. The tensioning ring and riser assembly according to claim 1 wherein the angle between the assembly centerline in said first direction and said leading faces of said female threads and between the assembly centerline in said first direction and said trailing faces of said male threads is from about 8° to 18°.

3. The tensioning ring and riser assembly according to claim 1 wherein the angle between the assembly centerline in said first direction and said leading faces of said female threads and between the assembly centerline in said first direction and said trailing faces of said male threads is about 15°.

4. The tensioning ring and riser assembly according to claim 1 wherein the angle between the assembly centerline and each of said trailing faces of said female threads and said leading faces of said male threads is from about 88° to 90°.

5. The tensioning ring and riser assembly according to claim 1 wherein the angle between the assembly centerline and each of said trailing faces of said female threads and said leading faces of said male threads is about 88.5°.

6. The tensioning ring and riser assembly according to claim 1 wherein said male and female threads each have rounded tips configured to avoid contact with the root of the opposite thread.

7. The tensioning ring and riser assembly according to claim 1 wherein the configuration of each of said rounded thread roots is elliptical with the longer axis of the ellipse lying approximately parallel to the assembly centerline.

8. The tensioning ring and riser assembly according to claim 7 wherein said ellipse has a length about twice the width.

9. The tensioning ring and riser assembly according to claim wherein said tensioning ring comprises:

an outer ring;

a split upper slip ring within said outer ring and bearing said female threads on an interior surface;

a split lower nut coaxial with said split slip ring, within said outer ring and bearing said female threads on an interior surface.

10. The tensioning ring and riser assembly according to claim 9 wherein each of said split upper slip ring and said split lower nut are axially divided into at least two parts and include means for securing said parts together to form said ring and nut.

11. A tensioning ring and riser assembly for use in a riser tensioning apparatus which comprises:

a riser having male threads formed on the exterior surface;

a tensioning ring having female threads formed on the interior surface;

said female threads configured and sized to thread onto said male threads with a loose fit;

said female threads having leading faces adapted to be axially forced against the corresponding trailing faces of said male threads in a first direction along the centerline of said assembly of tensioning ring and riser;

the leading faces of said female threads and trailing faces of said male threads extending in said first direction having an angle to said centerline in said first direction of from about 8° to 18°;

the trailing faces of said female threads and leading faces of said male threads having an angle to said centerline in said first direction of about 88° to 80°;

the thread roots of said male and female threads having a rounded cross section;

whereby when said tension ring is forced in said first direction only the leading face of the threads are in contact and when there is no force in said first direction the only contact is at the leading face of the female thread root and the trailing face of the male thread crest permitting rotation of the tensioning ring around the riser with minimal effort.

12. The tensioning ring and riser assembly according to claim 11 wherein the angle between the assembly centerline in said first direction and said leading faces of said female threads and between the assembly centerline in said first direction and said trailing faces of said male threads is about 15°.

13. The tensioning ring and riser assembly according to claim 11 wherein the angle between the assembly centerline and each of said trailing faces of said female threads and said leading faces of said male threads is about 88.5°.

14. The tensioning ring and riser assembly according to claim 11 wherein said male and female threads each have rounded tips configured to avoid contact with the root of the opposite thread.

15. The tensioning ring and riser assembly according to claim 11 wherein the configuration of each of said rounded thread roots is elliptical with the longer axis of the ellipse lying approximately parallel to the assembly centerline.

16. The tensioning ring and riser assembly according to claim 11 wherein said ellipse has a length about twice the width.

17. The tensioning ring and riser assembly according to claim 11 wherein said tensioning ring comprises:

an outer ring;

a split upper slip ring within said outer ring and bearing said female threads on an interior surface;

a split lower nut coaxial with said split slip ring, within said outer ring and bearing said female threads on an interior surface.

18. The tensioning ring and riser assembly according to claim 17 wherein each of said split upper slip ring and said split lower nut are axially divided into at least two parts and include means for securing said parts together to form said ring and nut.

* * * * *